US008662096B2

(12) United States Patent
Stehly

(10) Patent No.: US 8,662,096 B2
(45) Date of Patent: Mar. 4, 2014

(54) FOLDING STRUCTURE THAT CAN BE UNFOLDED AND REFOLDED QUICKLY

(75) Inventor: Alain Stehly, Charnay (FR)

(73) Assignee: Vitabri, Societe Anonyme, Besancon (FR)

( * ) Notice: Subject to any disclaimer, the term of this patent is extended or adjusted under 35 U.S.C. 154(b) by 39 days.

(21) Appl. No.: 13/212,296

(22) Filed: Aug. 18, 2011

(65) Prior Publication Data

US 2012/0006373 A1 Jan. 12, 2012

Related U.S. Application Data

(63) Continuation-in-part of application No. 12/527,157, filed as application No. PCT/FR2007/051792 on Aug. 7, 2007, now abandoned.

(30) Foreign Application Priority Data

Feb. 27, 2007 (FR) ..... 07 53514

(51) Int. Cl.
*E04H 15/46* (2006.01)
*E04H 15/60* (2006.01)
*E04H 15/32* (2006.01)

(52) U.S. Cl.
USPC ..... 135/140; 135/114; 135/120.2

(58) Field of Classification Search
USPC ..... 135/114, 119, 120.1, 120.2, 145, 157, 135/139, 142, 140, 144, 146; 426/114, 119, 426/120.1, 120.2, 145, 157, 139, 142, 140, 426/144, 146
See application file for complete search history.

(56) References Cited

U.S. PATENT DOCUMENTS

| | | | | |
|---|---|---|---|---|
| 1,853,367 | A * | 4/1932 | Mace | 135/123 |
| 2,723,673 | A * | 11/1955 | Call | 135/140 |
| 4,553,496 | A * | 11/1985 | Foresman | 114/144 R |
| 5,632,292 | A * | 5/1997 | Carter | 135/145 |
| 6,508,262 | B1 * | 1/2003 | Takayama | 135/145 |
| 6,575,656 | B2 * | 6/2003 | Suh | 403/109.6 |
| 6,591,849 | B1 * | 7/2003 | Swetish et al. | 135/140 |
| 7,246,779 | B2 * | 7/2007 | Doyle | 248/188.8 |
| RE40,657 | E * | 3/2009 | Suh | 403/109.3 |
| 7,637,275 | B2 * | 12/2009 | Stehly et al. | 135/139 |
| D630,289 | S * | 1/2011 | Stehly et al. | D21/839 |
| 2007/0204897 | A1 * | 9/2007 | Habib et al. | 135/145 |

* cited by examiner

*Primary Examiner* — Noah Chandler Hawk
(74) *Attorney, Agent, or Firm* — Egbert Law Offices, PLLC

(57) ABSTRACT

A folding shelter structure capable of being reconfigured from an unfolded position to a folded position, and vice versa. The structure has telescopic uprights each having at least one lower element sliding outside an upper element secured to said structure and which support a collection of mutually-adjacent prismatic box structures. The walls of which having crisscross longitudinal members articulated in the manner of scissors. The structure is characterized in that said structure has indexing means that are built into said telescopic uprights, in order to block and maintain the lower element and the upper element in the folded position, in the unfolded position or in at least one intermediate position between the folded and unfolded positions.

7 Claims, 6 Drawing Sheets

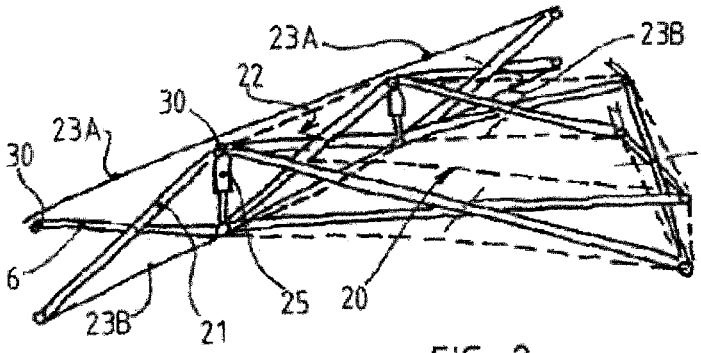
FIG. 2
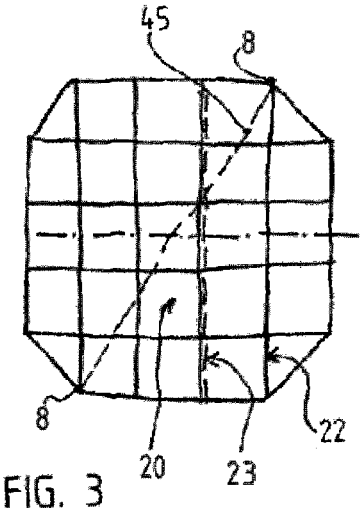
FIG. 3
FIG. 4
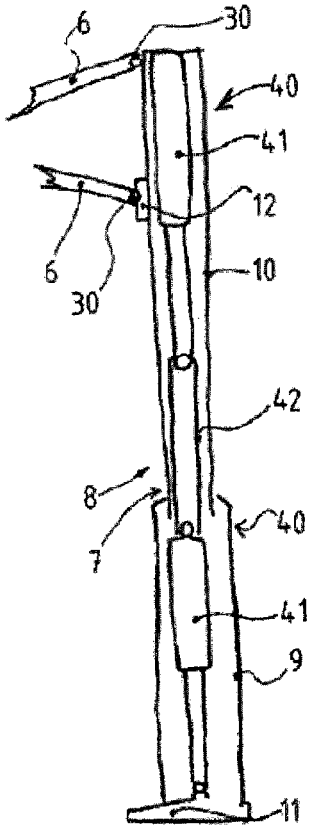
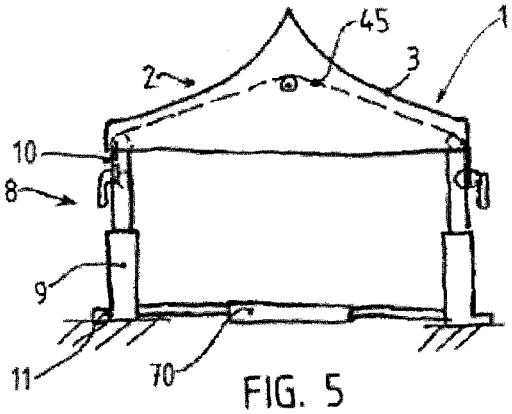
FIG. 5
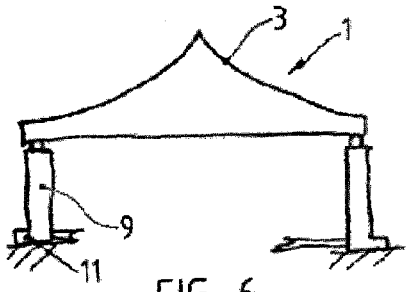
FIG. 6

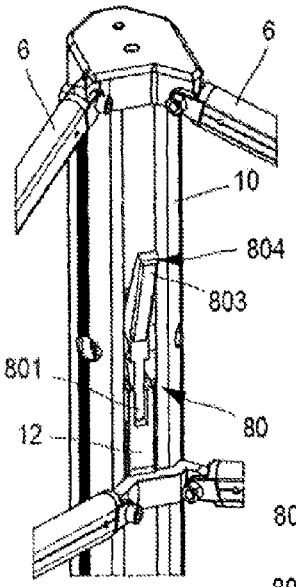
FIG. 7A
FIG. 7B
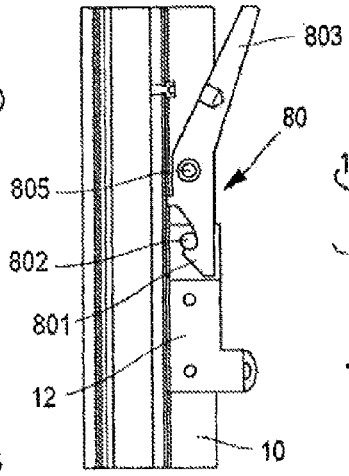
FIG.9
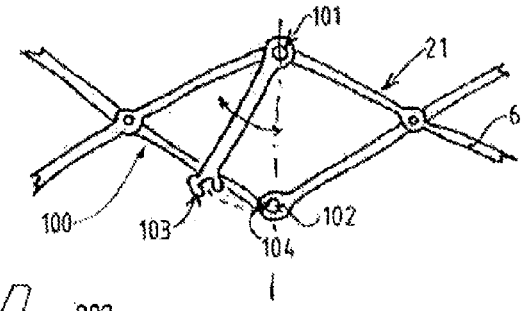
FIG. 10
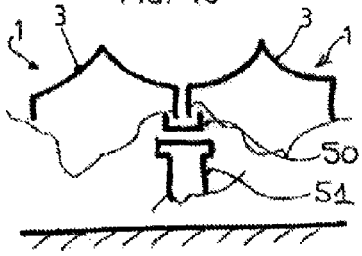
FIG.8
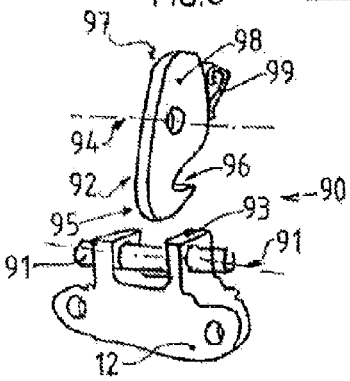
FIG. 11
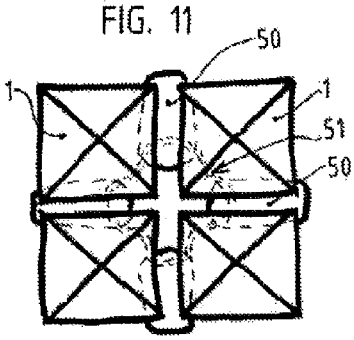

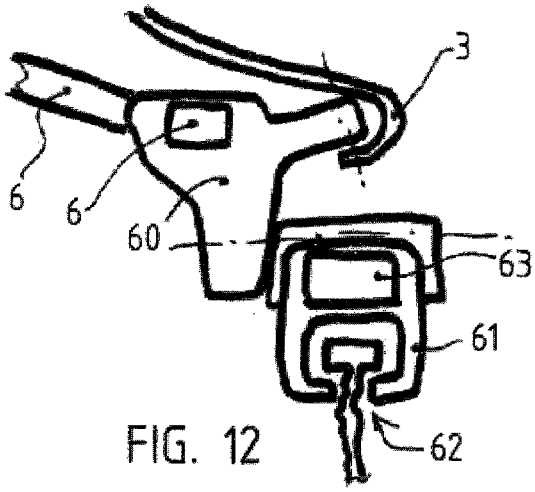
FIG. 12
FIG. 13
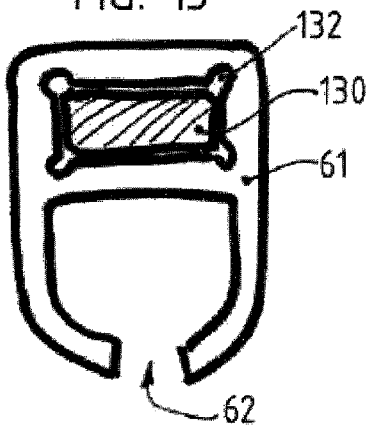
FIG. 14
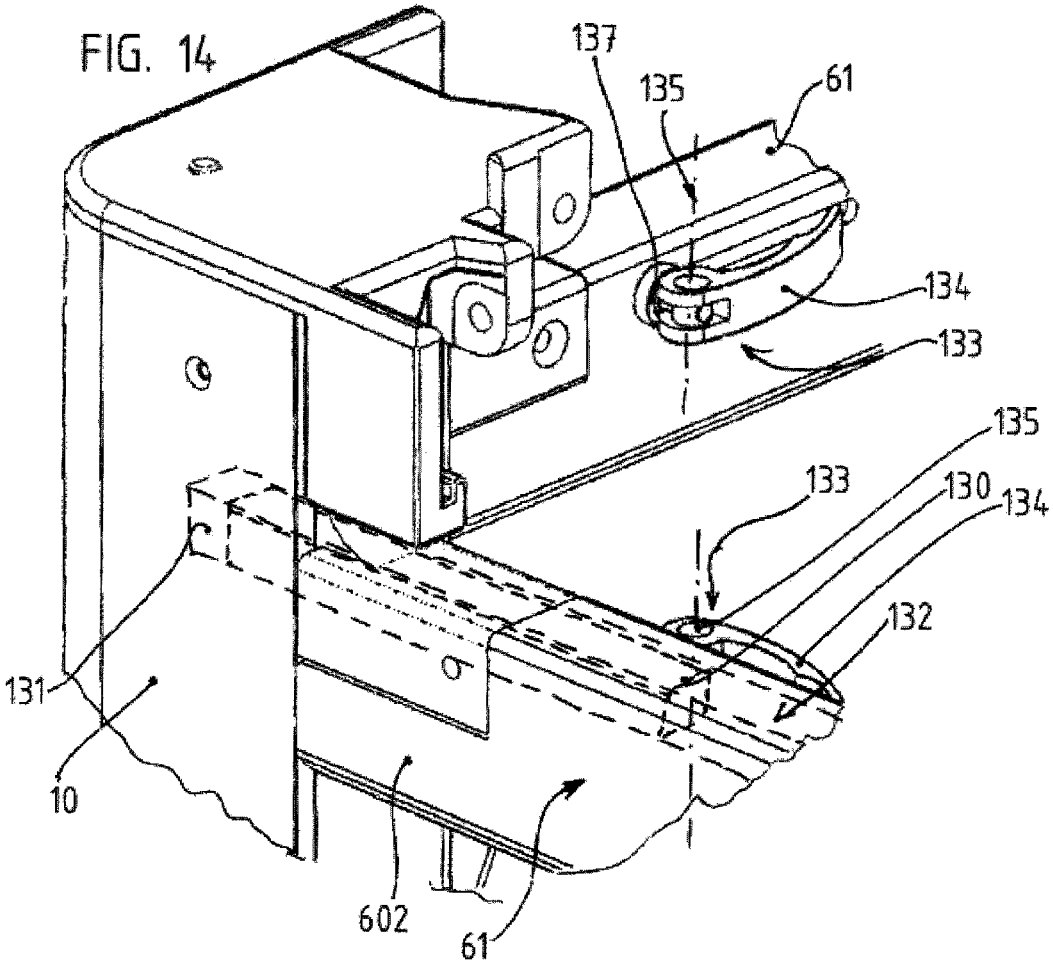

FIG. 20
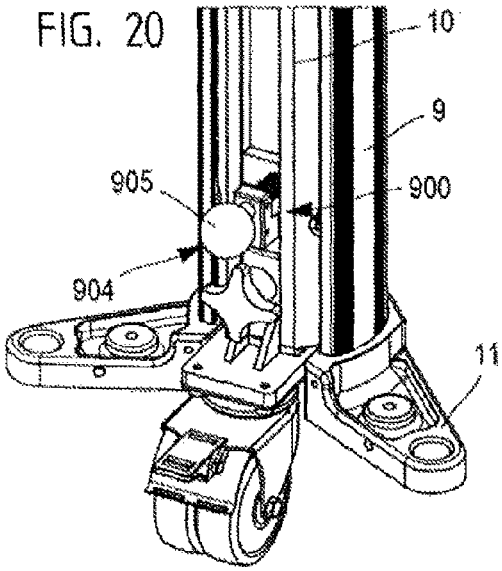
FIG. 22
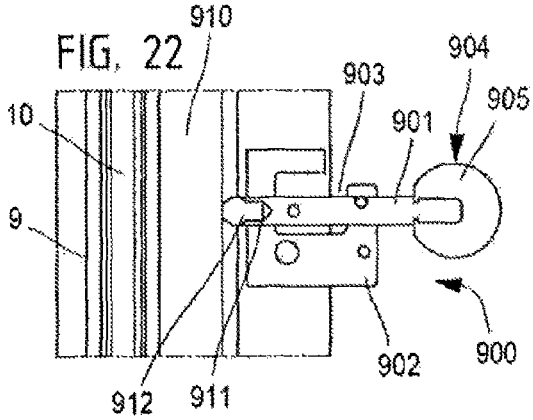
FIG. 21
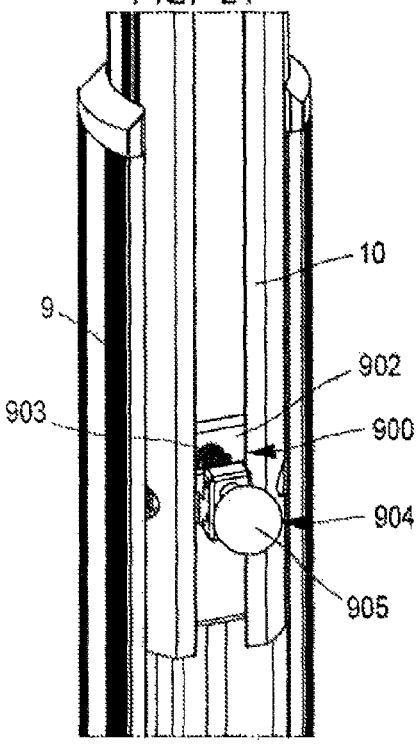
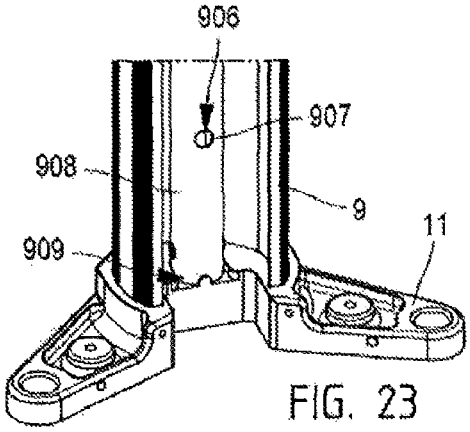
FIG. 23
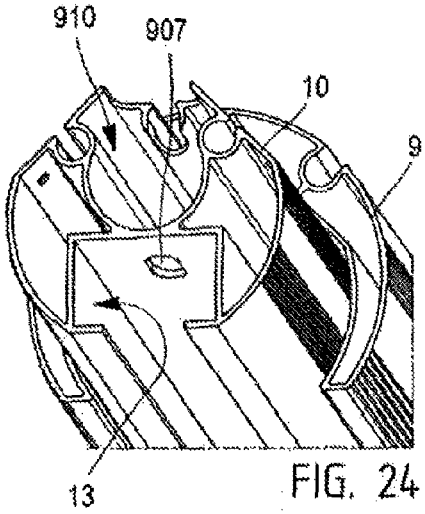
FIG. 24

FOLDING STRUCTURE THAT CAN BE UNFOLDED AND REFOLDED QUICKLY

CROSS-REFERENCE TO RELATED APPLICATIONS

The present application is a continuation-in-part of U.S. patent application Ser. No. 12/527,157, filed on Aug. 13, 2009, and entitled "Folding Structure That Can Be Unfolded and Refolded Quickly", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

This invention relates to a folding structure, capable of passing from an unfolded position to a folded position, and vice versa, comprising telescopic uprights including each at least one lower element sliding with respect to an upper element integral with said structure, and which support a collection of mutually-adjacent prismatic box structures, and the walls of which consist of criss-cross longitudinal members articulated in the manner of scissors.

The invention also relates to an upright for forming such a structure.

This invention is related to the field of knockdown or folding structures designed to be used as a shelter.

2. Description of Related Art Including Information Disclosed Under 37 CFR 1.97 and 37 CFR 1.98

Such a shelter generally consists of a metallic structure covered, at least in its upper portion, by a covering element forming a roof. Said shelter is most often, in the unfolded position, in the form of a tent having the shape of a cube surmounted by a pyramid.

This type of shelter is designed for a specific use, such as a stand or the like, over a certain period, requiring then assembly and disassembly, both simple and fast. This is why existing shelters have been designed to be unfolding, passing from a folded configuration, for their transport and their storage, to an unfolded position, or vice versa. This possibility to fold and unfold the shelter facilitates greatly its assembly in comparison with shelters comprising a structure consisting of longitudinal members, rods or bars that are removable and made integral to each other by means of fastening elements.

As to the folding shelter, it includes a structure generally consisting of longitudinal members made of a metallic material, for example of aluminum or aluminum compound sections, or also of composite material such as fiberglass or carbon fiber, or the like. Said longitudinal members are articulated between them so as to permit the passing of said shelter from a folded position to an unfolded configuration, or vice versa.

In addition, the covering element is secured to said structure so that the folding or the unfolding of the shelter does not require the removal of said covering element. To this end, the latter is made in the form of a tarpaulin made of textile or plastic material, or the like, flexible and waterproof, fastened to said structure.

However, the existing folding shelters are limited in dimensions because of the bearing capacity of the structure and the weight the articulated longitudinal members support as well as the overall weight of the structure. The existing shelters generally have a maximum ground area of 24 square meters. For larger areas, it is necessary to resort to classical knockdown shelters.

The implementation of large-size shelters, in the range of 5×5 meters or even more, offers its owner undeniable commercial advantages: great surface and volume capacity, a neat appearance, and excellent visibility. The last factor is particularly important while participating at exhibitions, where each exhibitor would like to distinguish himself from his neighbors, in particular by the volume and height of his installations.

In order to permit in particular an extension in height of such a shelter, it is advisable to design such shelters with a high structure comprising legs or uprights having a large size, or at least comprising an area that is higher than the rest, which then imposes using one or more poles.

The essential service stresses, subject to standardization in many countries, consist of:

wind load resistance;

resistance to a load of rain or snow which can accumulate on the roof of such a shelter.

Such standards impose the evacuation of the public in case of exceeding the thresholds of wind speed or static load. Besides, it is in the owner's interest, in such a case, to reduce the wind contact surface, to relieve the roof from its shelter, and even to fold up or disassemble the latter very quickly if the conditions become extreme.

Such a structure, having a large surface and great height, is necessarily heavier and also more complex than a structure designed uniquely to permit, at ground level, the passage of the public, and the size of which is adjusted to the height standards for the circulation of persons.

In particular, the weight of a shelter having a large size, for example having a ground surface of 5×5 meters, is, even if light materials are used, a weight, in particular above 100 kg, that cannot be easily handled by one person.

Disadvantages related to the weight of a large structure are even more amplified by the expansion in height of the latter.

BRIEF SUMMARY OF THE INVENTION

The object of the invention is to cope with the disadvantages of the state of the art by offering a folding shelter structure capable of passing from an unfolded position to a folded position, and vice versa, comprising telescopic uprights including each at least one lower element sliding with respect to an upper element integral with said structure, and which support a collection of mutually-adjacent prismatic box structures, and the walls of which include criss-cross longitudinal members articulated in the manner of scissors, wherein said upper element slides inside said lower element.

Moreover wherein each telescopic upright comprises indexing means in order to block and maintain the lower element and the upper element in the folded position, in the unfolded position or in at least one intermediate position between folded and unfolded positions, indexing means being formed of a finger comprising a longitudinal rod, mounted articulated from a locking position to an unlocking position in a translation movement on a plate fixed at the bottom of the upper element, said opposite end of said finger fitting into complementary means comprising at least a hole made into the lower element, said hole corresponding to one of the intermediate positions, the bottom hole corresponding to the folded position while the upper one corresponds to the unfolded position of the upright.

Further, said lower element comprises a tube which bottom end is fixed to bottom end the lower element and which extends along said lower element, said holes of the complementary means being made into said tube.

In the preferred embodiment, said upper element slides into the profile of the lower element and simultaneously slides outside the tube, the lower element, the upper element and the internal tube being concentric, said upper element comprising an internal longitudinal space, with the same cross-section shape than the cross-section shape of said tube and with a diameter a little bit larger, wherein and along which slides said tube.

According to one specific feather of the invention, said finger is further equipped with elastic restoring means comprising as a compression spring tending to automatically push said finger into the locking position.

Moreover, said finger comprises gripping means comprising a spherical handle fixed at the free end of said finger, in order to manually draw the finger into the unlocking position during lifting or lowering of the upper element into and along the lower element.

According to a feature of the invention said structure comprises unfolding or re-folding means being formed of pneumatic jacks and being incorporated into said tube of said telescopic uprights.

The invention is thus configured to permit its easy implementation with a reduced staff, and even by one person.

An advantage of the structure according to the invention resides in that it offers, beyond a ground surface of 24 square meters, an alternative to the utilization of knockdown structures.

Other features and advantages of the invention will become more evident from the following detailed description of non-restrictive embodiments of the invention, referring to the figures attached thereto.

BRIEF DESCRIPTION OF THE SEVERAL VIEWS OF THE DRAWINGS

FIG. 2 shows, in a schematic and perspective way, the structure according to the invention, as well as its reinforcement by tension cables.

FIG. 3 is a schematic bottom view of an unfolded folding structure according to a symmetry with respect to a plane.

FIG. 4 shows, in a schematic way, unfolding or re-folding means of a structure according to the invention.

FIG. 5 is a schematic elevation view of other means for reinforcing the rigidity of the structure according to the invention shown in the unfolded position.

FIG. 6 is a schematic view of a structure according to FIG. 5 brought close the ground.

FIG. 7A is a schematic perspective top view of a part of an upright and of the articulation of a structure according to the invention.

FIG. 7B is a schematic partial vertical cross view of FIG. 7A.

FIG. 8 is a schematic perspective exploded view of the locking/unlocking means of the structure in the unfolded position.

FIG. 9 is a schematic elevation view of the means for reinforcing the rigidity of the structure according to the invention.

FIG. 10 is a schematic elevation view of a device for collecting rain water at the junction of several folding structures.

FIG. 11 is a schematic top view of the device for collecting rain water at the junction of several folding structures of FIG. 10.

FIG. 12 is a schematic cross-sectional view of a coupling cross-piece according to the invention.

FIG. 13 is a schematic cross-sectional view of a horizontal traverse of a structure according to the invention.

FIG. 14 is a partial schematic perspective view of the junction of a horizontal traverse according to FIG. 13 with an upright.

FIG. 20 is a partial schematic perspective view of the bottom of the uprights in the folded position according to the preferred embodiment of the invention.

FIG. 21 is a partial schematic perspective view of the upper element blocked into the lower element by indexing means.

FIG. 22 is a partial vertical cross-sectional view of FIG. 21.

FIG. 23 is a partial schematic perspective view of a lower element in the unfolded position.

FIG. 24 is a partial perspective view of the cross-section of an upright.

DETAILED DESCRIPTION OF THE INVENTION

Figure 1A:
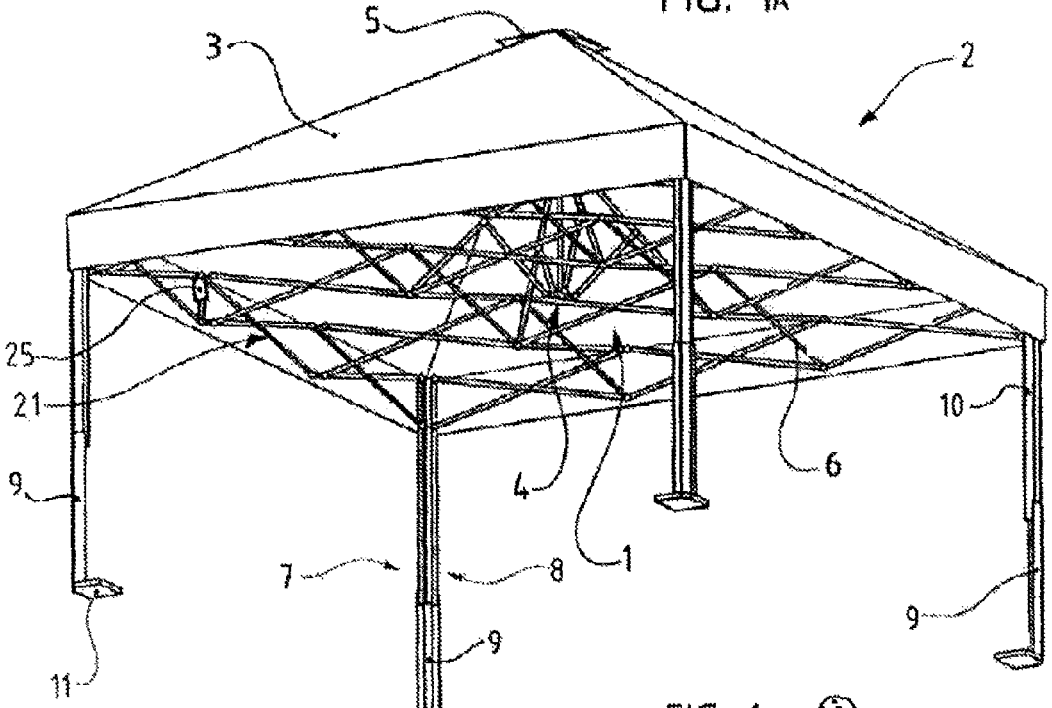
FIG. 1A is a schematic perspective bottom view of a structure according to the invention in the unfolded position.
Figure 1B:
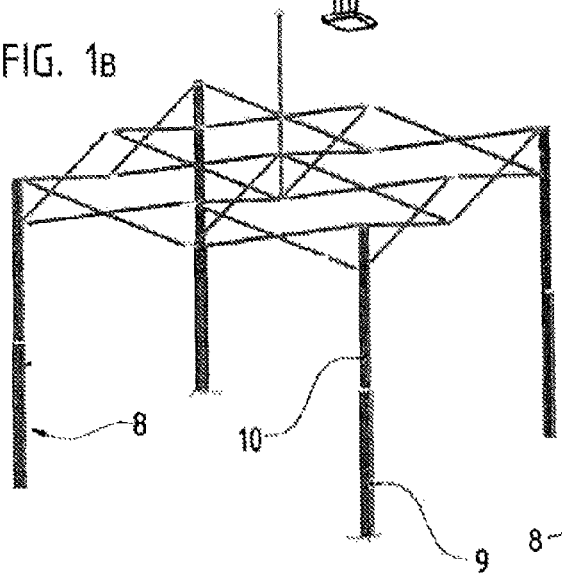
FIG. 1B is a schematic perspective top view of a structure according to the invention in the unfolded position without cover.
Figure 1C:
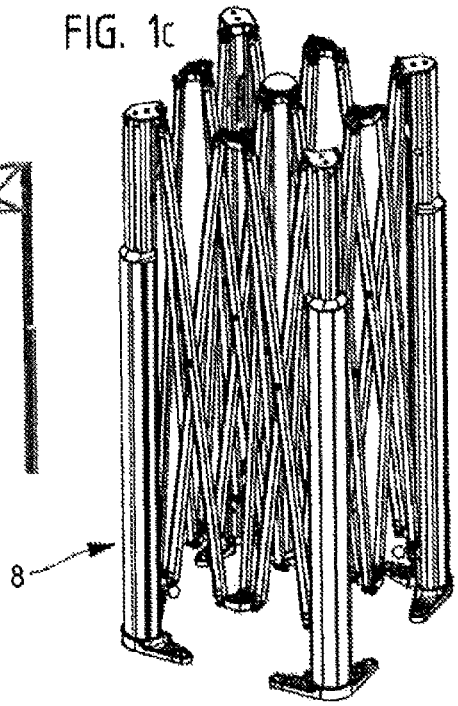
FIG. 1C is a schematic perspective top view of a structure according to the invention in a quite folded position.

This invention relates to a folding structure 1 capable of passing from a folded position of storage or transport to an unfolded position, or vice versa, and designed to form a shelter 2 in the unfolded position. The unfolded position is shown in FIGS. 1A and 1B.

Said shelter 2 includes covering means 3 integral with said structure 1 so as to be withdrawn along the latter during the refolding of said shelter 2. Said covering means 3 can be advantageously in the form of a tarpaulin having a single or double curvature, made of a plastic compound or of any other material. Said tarpaulin is put under lateral tension by the unfolding of the structure 1. In addition, a central pole 4 puts said tarpaulin under vertical tension. Said pole can advantageously be installed in the form of a cam, so as to ascend or descend under the rotating action of a crank, not represented. Under tension, the covering means 3 form a substantially pyramidal roof. Said roof can be crowned by a cap 5 integral with the upper end of said pole 4.

The structure 1 includes longitudinal members 6 articulated between them so as to form a mesh permitting its folding and unfolding. Said longitudinal members 6 are movable in the manner of accordions on scissor-type articulations 30 so as to permit them to move apart or bring them closer, the extension or contraction of said longitudinal members 6 being carried out transversely in a horizontal plane.

The skeleton of the structure 1, formed by the longitudinal members 6, is designed to give it, through its rigidity, a good wind load resistance. As a matter of fact, the wind load resistance constitutes the biggest obstacle to the making of large size shelters, whether unfolding or not. To this end, the skeleton of the structure is designed in the form of a collection of boxes 20 adjacent to each other, and the walls of which are formed by such longitudinal members 6 articulated in the manner of scissors.

As shown in FIG. 2, the longitudinal members 6 constitute, assembled and articulated by articulations 30, substantially flat sides 22 of said boxes 20, the latter being represented in dotted lines.

Therefore, the longitudinal members 6 define between them deformable boxes 20, juxtaposed to each other, and deforming necessarily together.

Preferably, and as shown in FIGS. 1A, 1B and 2, the longitudinal members 6 on each side 22 are assembled in crisscrosses 21, in the shape of full lozenges in the center of the structure 1, and of semi-lozenges at the periphery of the latter.

The structure 1 preferably comprises a symmetry of construction with respect to at least one vertical plane passing through its highest point, corresponding to a pole 4.

In particular applications, as shown in FIG. 1A, 1B or 3, in the case of planes in polygons having an even number of sides, parallel and equal two by two, the structure 1 is symmetric with respect to a vertical axis that passes through its highest point, coinciding with the axis of its pole 4.

In the case of structures of a more complex shape, in particular rectangular, the structure 1 is symmetric with respect to a plane of symmetry that passes through several high points, having the same or different height.

The longitudinal members 6 are arranged so as to remain, during their operation, in planes that are parallel to the axis of symmetry if it exists, or parallel to a vertical axis of the plane of symmetry.

In a preferred application, and in the case of a polygonal plane structure, each side of the polygon serves as support to an odd number of boxes 20. Thus, in particular in the case of a vertical symmetry axis structure, said axis is, in the central part of the structure, surrounded by at least one box 20. This arrangement permits in particular to create oblique bracing means, resting on said box 20 situated at the axis, so as to reinforce the pole 4 passing through the axis of symmetry.

In case of strong wind, horizontal component tangential stresses to which the upper portion of the covering means 3 is subjected are supported by the pole 4. Such a structure, boxed and centered around the pole 4, permits to oppose a good resistance to horizontal stresses. It also permits to ensure the preservation of the geometry of the entire shelter structure 1.

Depending on the number of boxes 20 resting on each side of the polygon, the central box 20 thus formed is inscribed in homothetic structures of a larger size.

The structure 1 comprises uprights 8, each comprising telescopic foundation means 7 formed of at least one lower portion 9 and of one upper portion 10.

The invention is also designed to permit its easy implementation by a quite reduced staff, even by one person, with the help of a device for raising, assembling, lowering, and disassembling the structure 1.

To this end, the upright 8 are advantageously equipped, between at least two elements, which they are comprised of, in particular the lower element 9 and the upper element 10, with unfolding means 40, as shown in FIG. 4.

Said unfolding means 40 permit to carry out both the operation of unfolding of each upright 8 proper, by moving apart its lower portion 9 and its upper portion 10 and by thus contributing to the raising of the structure 1, and the inverse operation of refolding, consisting in getting them closer, during which operation the unfolding means 40 prevent the structure 1 from collapsing, by supporting it during a controlled descent. Said unfolding means 40 can in particular be formed of jacks that are pneumatic, hydraulic, electro-mechanical or the like.

Preferably, and absolutely non-restrictively, the unfolding means 40 are formed of one or more light and autonomous pneumatic jacks 41 characterized by the absence of equipment such as a battery or the like. They can also be formed of a series of several small pneumatic jacks 41, having a small stroke, so as to remain compatible with the small size required in the folded position. Spacers 42 permit, if necessary, to adjust the strokes of such jacks 41.

For example, by equipping with pneumatic jacks 41 the four uprights of a square shelter structure 2 of 5 meters by 5 meters, which, provided with covering means 3 in the form of a tarpaulin, has a weight in the range of 130 kg, the assembling can be carried out by a quite small team, and even by one person, without any particular muscular effort. Moreover, one can thus avoid any risk of jamming or falling during the operation.

Preferably, all the guides are of the type plastic, such as polyamide on glass fiber, on an aluminum alloy, so as to reduce friction as much as possible.

Said unfolding means 40 permit to ensure, besides the functions of raising and lowering the structure 1, the non-return function by maintaining in position, and, something quite appreciable on uneven ground, the balancing between the different uprights 8.

It should also be noted that, during strong winds, it is possible to bring the unfolded structure, corresponding to the deployed configuration of FIG. 5, closer to the ground, in order to reduce the wind contact surface, with the aid of the unfolding means 40, as shown in FIG. 6.

Moreover, each telescopic upright 8 comprises indexing means 900 in order to block and maintain the lower element 9 and the upper element 10 in the folded position, in the unfolded position or in at least one intermediate position between folded and unfolded positions.

As shown in FIGS. 21 and 22, the indexing means 900 are formed of a finger 901, such as a longitudinal rod, mounted articulated from a locking position to an unlocking position in a translation movement on a mounting support fixed at the bottom of the upper element 10. In particular, said mounting support comprises a plate 902 directly screwed into a thread made into the profile of the upper element 10.

The finger 901 is also equipped with elastic restoring means, such as a compression spring 903, tending to automatically push said finger 901 into the locking position. Gripping means 904, such as a stud or a spherical handle 905, are fixed at the free end of said finger 901, in order to manually draw the finger 901 into the unlocking position during lifting or lowering of the upper element 10 into and along the lower element 9.

Moreover, when said finger 901 is pushed into the locking position, due to the action of said spring 903, the opposite end of said finger 901 fits into complementary means 906, such as at least a recess or a hole 907, made into the lower element 9.

So the opposite end 911 forms a male part fitting into a corresponding female part consisting of said hole 907. In the preferred embodiment, said opposite end 911 of the finger 901 comprises a ball 912 which fits into the hole 907. Moreover, said ball 912 can be made into a plastic material in order to avoid to deteriorate or to strike the surface of said lower element 9 during lifting or lowering.

In particular, said complementary means 906 comprise a plurality of recesses or holes 907 distributed along the lower element 9. When said finger 901 is fitted into a recess or hole 907, said recess or hole 907 corresponds to one of the intermediate positions, the bottom recess or hole 907 corresponding to the folded position while the upper one corresponds to the unfolded position of the upright 8.

In a first embodiment, not shown on the drawings, said recesses or holes 907 of the complementary means 900 are made into the profile of the lower element 9.

In the preferred embodiment, as shown on FIG. 24, the recesses or holes 907 of the complementary means 900 are made into a tube 908 being integral to the lower element 9. In particular, such tube 908 extends along and into the lower element 9. The bottom end 909 of said tube is fixed to the bottom end of said lower element 9, especially on the base 11 of said lower 9.

Moreover, said tube 908 includes a supplementary guide for the sliding of the upper element 10. So, said upper element 10 slides into the profile of the lower element 9 and simultaneously slides outside the tube 908. In order to obtain inside and outside sliding, the profile of the upper element 10 comprises an internal longitudinal space 910, with the same cross-section shape than the cross-section shape of said tube 908 and with a diameter a little bit larger. In the preferred embodiment, the cross-section shape of said space 910 is circular, so as said tube 908.

Therefore, the internal tube 908 provides a better longitudinal telescopic guiding of the upper element 10 into the lower element 9 and around said tube 908, the lower element 9, the upper element 10 and the internal tube being concentric.

Moreover, in the preferred embodiment, said internal tube 908 receives internally said pneumatic jacks 41, in order to protect them.

In order to facilitate a possible transport during extremely bad weather, the structure also comprises advantageously means for moving on the ground by sliding or rolling.

The utilization of unfolding means 40 makes also possible the creation of shelter structures comprising uprights 8 comprised each, besides of a lower element 9 and of an upper element 10, of intermediate elements.

Therefore, it is possible to erect shelters the uprights 8 of which have a considerable height.

For very large-size structures, one or more secondary unfolding means 25, as shown in FIG. 2, are positioned inside the articulated crisscrosses 21 that are formed, together, on the side of the boxes 20, which the structure is formed of, by the various longitudinal members 6.

The latter define a collection of lozenges or of semi-lozenges. The unfolding is assisted either by installing secondary unfolding means 25 at the level of the diagonals of the lozenges the length of which will increase during the unfolding, or by installing them at the level of the diagonals the length of which will diminish during the unfolding.

The latter configuration is preferred in the example of FIGS. 1B and 2, since in this case said secondary unfolding means 25 are parallel to the upright 8, which makes their installation much easier in a refolding structure.

Said secondary unfolding means 25 are also designed to reinforce the structure with respect to vertical stresses, such as the load constituted by the snow on the covering means 3. They maintain the diagonal spacing, and permit to limit the deformation of the structure 1 under the load. Advantageously, the secondary unfolding means 25 are made analogous to the unfolding means 40, and are preferably formed of pneumatic jacks.

The folding structures 1 according to the invention advantageously include first locking/unlocking means 80 in the folded position, associated to first complementary means 81.

At the level of the upright 8 of the structure the upper element 10 comprises, in a preferred embodiment, over the whole or part of its length, guiding means, such as a slide 13, designed capable of cooperating with rolling means integral with and articulated to the structure 1.

Said rolling means include a carriage 12 that slides inside the slide 13. Said carriage 12 supports the longitudinal members 6 adjacent to said upright 8 and articulated, at the level of their ends, to the latter for the unfolding of the structure 1.

The slide 13 is also designed to act as support for equipment for transporting fluids, power, communication means, in the form of kits fitting closely and comprising means for locking in the slide 13.

Moreover, the back of the throat of the slide 13 is perforated face to the finger of the indexing means, in order to allow its opposite end to cross such perforation and fits into the recess or hole of the complementary means. In particular, means for connecting to power supply or/and to communication means can be designed in the form of packs of electrical, optical, or other sockets, advantageously integrated in the upright 8.

As shown in FIG. 7A, the first locking/unlocking means 80 are formed, in the preferred embodiment, of a hook 801 fixed at the upper part of the upper element 10 and cooperating with a stop, such as a pin or an axle 802, fixed on the carriage 12 sliding inside the upright 8.

Obviously, the inverse configuration is absolutely conceivable.

Moreover, said hook 801 is articulated regarding to the profile of the upper element 10 in a rotation movement, through an axle 805, in order to pass from an initial locking position, wherein said hook 801 maintains said axle 802, to an unlocking position, and vice-versa. Said hook 801 comprises also pushing means 804 at its opposite end, such as tongue 803, which can be manually pushed in order to rotate the hook 801 and to unlock the axle 802. The hook 801 comprises elastic means, such as a spring, in order to automatically come back into the locking position.

The folding structures according to the invention advantageously include second locking or unlocking means 90 in the unfolded position, associated to second complementary means 91. Their configuration can be analogous to the means 80 and 81 described above. The complete unfolding of the structure corresponds to the situation in which the carriage 12 sliding in or on the upright 8 reaches its position that is farthest away from the ground. In order to facilitate the locking or unlocking operation without the operator having to use means such as stepladder, ladder or similar, a preferred embodiment, as shown in FIG. 8, includes locking/unlocking means 90 in the form of a handle 92. Said handle 92 is articulated on an axis 94 in the median position which is installed integral with the upright 8, it comprises, at a first end 95, a hook 96 that is designed capable of cooperating with complementary means 91 such as a trunnion or an axis the carriage 12 comprises, for example at the level of a lug 93. Elastic restoring means 99, such as a spring, tend to cause the hook 96 to cooperate with the axle 91. The handle 92 comprises, at a second end 97, an operating butt 98 the action of which permits to cancel the action of the restoring means 99, and to release the hook 96 from the axle 91.

Other optional locking means are advantageously as shown in FIG. 5, comprised of one or more tension cables 45 connecting between them at least two uprights 8, of the upper portion of the unfolded structure, by means of pulleys or guiding axles or the like, and designed capable of being tightened, once the structure 1 is completely unfolded, for example with the help of an eccentric handle or the like.

In a preferred application, the advancement of such tension cables 45 takes place inside the components of the structure 1, in particular of the longitudinal members 6 and of the upper portions 10 of the uprights 8. The latter are advantageously equipped with means for guiding and reversing said tension cables 45.

As shown in FIG. 2, other tension cables 23 are also advantageously used so as to reinforce the structure 1, completing the sides 22 of the boxes 20, which the structure 1 is formed of: said sides 22 of boxes are constituted by the crisscrosses 21, in the form of juxtaposed lozenges or semi-lozenges. The tension cables 23 are then used for completing the virtual structure of the sides 22 of the boxes 20, in the form of straight lines substantially parallel to the ground, at the level of the articulations 30, of the highest 23A or/and lowest 23B level of said sides 22 of boxes 20.

In order to perfect the geometry of the unfolded structure 1, especially in areas subjected to intense winds, bases 11, or/and lower portions 9 of the uprights 8, are advantageously arranged so as to receive the fastening of tie-rods 70, in particular telescopic-rods, ensuring an additional stiffening, as well as a perfect parallelism of the uprights 8, as shown in FIG. 5.

It is obvious that said tie-rods 70 are designed to operate both in traction and during buckling in compression. Said tie-rods 70 thus improve the resistance of the structure to conditions of extremely bad weather, considerable snowfalls, or violent winds parallel to the ground.

Said tie-rods 70, arranged preferably near the ground, can in particular be equipped with means for receiving curtains or partitions such as lower hooks or tighteners, or also be equipped with thresholds.

The latter equipment is particularly interesting when the shelter is designed to be provided with a floor that is both delimited and immobilized by the tie-rods 70.

In the case of construction of complex structures obtained as a result of the juxtaposition of several shelters according to the invention, the integral connection is made easily by means of fastening elements such as shackles in the upper portions, and such as beta pins at the level of the bases 11 on the ground.

In a simplified embodiment, as shown in FIG. 9, the locking means are constituted in the form of at least one longitudinal member-hook 100, which is articulated around an upper articulation 101 of at least one articulated crisscross 21.

This longitudinal member-hook 100 is provided at its lower portion with a hook 103 designed capable of cooperating with a trunnion 104, or the like, a lower articulation 102 situated on the vertical of said upper articulation 101 comprises.

The longitudinal member-hook 100 remains, under the effect of gravity, substantially parallel to the uprights 8 during the unfolding of the structure and the raising of the lower articulations 102.

Said hook 103 or said trunnion 104 preferably comprises means for immobilization in relative position with respect to each other, either by deformation, or through elastic restoring means such as a spring, or also through additional means for maintaining in position.

Said longitudinal members-hooks 100 thus permit, simply and efficiently, to reinforce the rigidity of the structure, through simple interlocking of the hooks 103 with the trunnions 104, in particular in case of severe meteorological conditions. They maintain then the diagonal spacing and permit to limit the deformation of the structure under the load.

In order to contribute to the reinforcement of the folding structure 1, and to make it possible to equip a shelter in good safety conditions, a cross-piece 60 has been offered, as shown in FIG. 12, designed to be fixed at the periphery of the unfolded structure, on the end of each longitudinal member 6 bearing the tarpaulin 3 at the level of a fastener or of a fastening screw.

Said cross-piece 60, which can advantageously include a folding lock, has a lower portion having a shape fit, for example in the form of a hook, for receiving and coupling at least one horizontal traverse 61. Said horizontal traverse 61 is suspended, it comprises itself preferably a slot 62 in the lower portion at the level of a runway for roller-type curtain fasteners, or the like.

Figure 19:
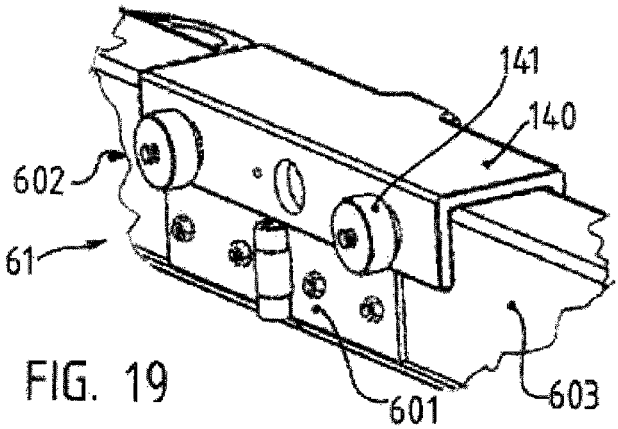
FIG. 19 is a partial schematic perspective representation of a rear view of FIG. 15.

In a preferred variant, horizontal traverses 61 are designed capable of being hitched, after the unfolding of the folding structure 1, at the level of the upper portions 10 of the uprights 8, in particular in cooperation with one or more recesses 131 said upper portions 10 include. Such a horizontal traverse 61 is preferably articulated so as to have a reduced size in the refolded position, compatible with that of the folding structure 1 itself. It then comprises at least one hinge 601 also acting as an extension stop in the unfolded position, as shown in FIG. 19. The horizontal traverse 61 comprises in particular at least a channel and a chamber for receiving lateral tarpaulins designed to form partitions of the folding structure 1, and their suspension casters.

In a particular version of the invention, the structure 1 is designed to resist to strong meteorological stresses, for example along the seashore or in the mountains.

The utilization of horizontal traverses 61 is then quite appropriate for rigidifying the structure.

In order to increase rigidity even more, the structure 1 incorporates at least one reinforcement 130, designed capable of cooperating with the upper portion 10 of the upright 8, and the horizontal adjacent traverse 61, so as to rigidify their connection, once the structure 1 is unfolded, the horizontal traverses 61 are mounted, and after the immobilization of said reinforcement 130 with the help of locking means 133.

As can be seen in FIG. 14, the upper portion 10 of the upright 8 comprises then a recess 131 designed capable of receiving the reinforcement 130 by means of sliding. Said reinforcement is actually enclosed in a horizontal traverse 61, at the level of a recess 132 the latter includes. The reinforcement 130 is operated manually, in the manner of a bolt, through operating means, which preferably also constitute locking means 133. In the embodiment shown in the figures, the reinforcement 130 comprises a finger 137 protruding at the level of a channel 136 made in the horizontal traverse 61. Said finger 137 serves as a support for the axis 135 of an eccentric lever 134, used for unlocking, operating in translation, and locking the reinforcement 130 with respect to the horizontal traverse 61. Advantageously, each upright 8 comprises two recesses 131 for cooperating with two adjacent horizontal traverses 61.

Figure 15:
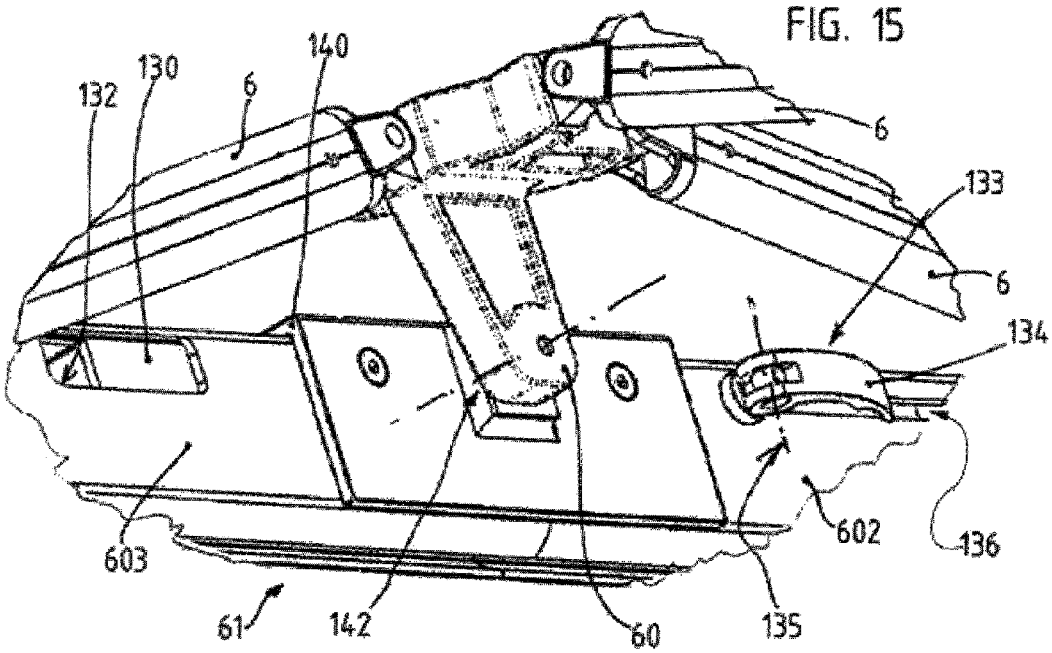
FIG. 15 is a partial schematic perspective view of the junction of two segments of a horizontal traverse according to FIG. 13.

Analogously, the structure 1 preferably incorporates at least one reinforcement 130, designed capable of cooperating with two adjacent segments 602 and 603 of a horizontal traverse 61, so as to rigidify their connection, once said traverse 61 is unfolded and resting on its hinge 601, and after the immobilization of said reinforcement 130 with the help of locking means 133. The same type of reinforcement 130 can be used, as shown in FIG. 15, in order to reinforce the junction of the two adjacent segments 602 and 603 of a horizontal traverse 61 after complete unfolding of the latter. The reinforcement 130 slides in the recesses 132 of the two adjacent segments 602 and 603, and secures them from the inside. The reinforcement 130 is immobilized with the help of locking means 133 of the abovementioned type. Preferably, all connections between segments 602 and 603 include such a reinforcement 130.

In a preferred version, the crisscrosses 21 of the folding structure 1 include such cross-pieces 60 for holding the covering means 3, in particular in the form of a tarpaulin, and for coupling a horizontal traverse 61. In the latter case, the cross-piece 60 advantageously comprises an arm designed capable of bearing the covering means 3, and of maintaining them sufficiently apart from the mechanical elements during the unfolding and folding operations, so as to avoid any jamming.

Considering that the folding structures according to the invention should be capable of being unfolded on any type of terrain, in particular an uneven terrain, it is important to be able to adjust its position with respect to the ground.

To this end, the cross-piece 60 that is mounted integral with the folding structure 1 is also mounted integral, based on a pivoting connection, with a junction piece 140.

Said junction piece 140 is designed to be capable of reinforcing, from the outside, the junction of the two segments 602, 603 of a horizontal traverse 61 adjacent to each other, on the outside of which it is designed capable of being immobilized by rapid immobilization means 141, such as quarter-turn nuts or similar. The junction piece 140 preferably has a U-shaped section, which straddles the adjacent segments 602 and 603.

In this case, the junction piece 140 can be left permanently on the folding structure 1, or be mounted on the cross-piece 60 after the unfolding of the structure 1.

The pivoting connection between the cross-piece 60 and the junction piece 140 is made at the level of a pivot 142 the latter comprises. It is obvious that it is then easy, during the subsequent assembling of the corresponding horizontal traverse 61, to adjust at will the angular position of the latter, in so far as the recesses 131 of the upper portions 10 of the uprights 8 are designed to allow a clearance permitting this adjustment before immobilization.

Said cross-piece device 60 receiving a horizontal traverse 61 can also be used for creating mid-height divisions, of the type "American bar", at the periphery of the shelter, or even for partitioning the latter.

The covering means or tarpaulins 3 of the adjacent structures in such a composition of shelters are connected, at their periphery, through discharging means such as a conical gutter 50, preferably coupled to the tarpaulins 3 of the respective shelters through Velcro fasteners, as shown in FIG. 10. As shown in FIG. 11, said conical gutter 50 permits to carry off rainwater toward a collection means 51, which can be situated at the point of confluence of several adjacent shelters, before draining through a down pipe, either flexible or rigid, below the level of the floor or of the ground.

Preferably, the arrangement of the uprights 8 and of the bases 11 is designed to permit the juxtaposition in a square of four uprights 8 of four different shelters, and to constitute between them a channel capable of receiving the collection means 51 in the upper portion, and the down pipe underneath.

Generally, bad weather usually poses numerous utilization problems for shelters having a flexible tarpaulin, both because of the wind contact surface and because of the accumulation of rainwater at the level of water pockets, formed alongside the peripheral coupling frame of the tarpaulin.

This is generally prejudicial to the coupling of accessories in good conditions of preservation, and even to safety in the case of electrical accessories.

Advantageously, the horizontal traverse 61 also comprises a waterproof compartment 63 designed capable of receiving electrical circuits or the like.

In this respect, the electrical supply of a shelter according to the invention is, in a particularly advantageous manner, provided by photovoltaic cells at the level of the covering means 3 or strips at the periphery of the latter, or also by means of batteries.

Such an arrangement with suspended accessories avoids thus the recreation of a water pocket threshold.

The maintenance of the tarpaulin 3 at the level of the angles can advantageously be made with the help of a mechanical shackle for coupling the guying.

At ground level, bases 11 are preferably equipped with orifices for receiving pickets, in case of setting up the shelter structure on a loose soil.

The pole 4 can assume different configurations, solid or pierced, and in particular for receiving or constituting a lightning rod. In a particular application, it is also designed capable of receiving an anemometer, so as to measure the basic dynamic pressure due to the wind.

Thus, the structure 1 according to the invention is preferably provided with different physical quantity sensors, in particular, at the level of the longitudinal members 6 and/or of the articulations 30, with strain gauges permitting to measure the overload due to snow.

The installation of a processing unit permits the recording of the values of said physical quantities, their comparison with instructions, and the activation of signals, for example for setting off an evacuation alarm if meteorological conditions constrain the owner of the structure to start its evacuation, according to the national standards, if the basic dynamic pressure and the snow overload exceed the thresholds defined by the regulations.

In order to improve the visibility, and in particular during bad weather, of the structure 1, the latter, in a preferred embodiment, comprises, at the level of at least one upright 8, means 108 for receiving signalization means 109, in particular in the form of a rabbet 110 for receiving a light garland 120 or a string of LEDs or the like forming said signalization means 109.

Figure 16:
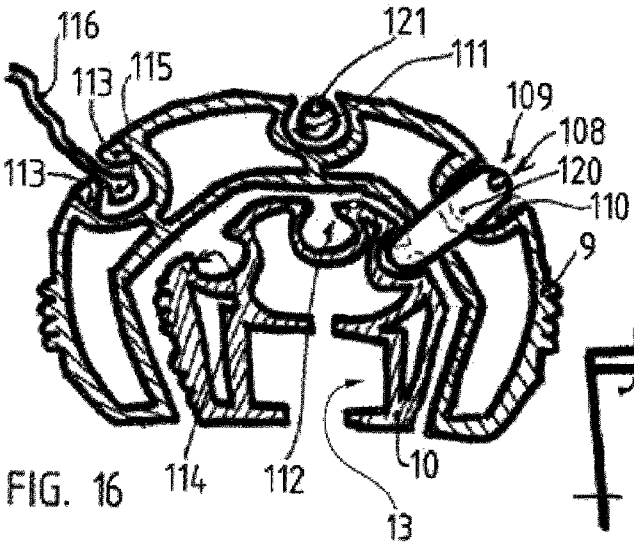
FIG. 16 is a schematic transversal cross-sectional representation, at the level of the area of junction of its lower portion and of its upper portion, of a particular embodiment of an upright of a structure according to the invention.

Preferably, and as shown in FIG. 16, the lower portion 9 and the upper portion 10 of each upright 8 include each such a rabbet 110, in the preferred form of a groove, 111 and 112 respectively, designed capable of receiving, either a single garland 120, or garlands 121 and 122 respectively in the grooves 111 and 112. Preferably, the cross-section of said groove 111 or 112 is circular, so as to receive a garland 120 or 121 or 122 having a round cross-section, the groove is secant with the external profile of the respective cross-section, so as to make the signalization means 109 visible on at least one portion of their periphery.

Figure 18:
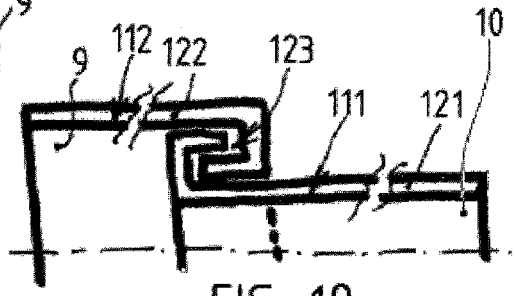
FIG. 18 is a schematic longitudinal cross-sectional representation of a particular embodiment of an upright of a structure according to the invention.

As shown in FIG. 18, the garlands 121 and 122 are advantageously designed capable of cooperating, when the lower portion 9 and the upper portion 10 of the upright 8 are completely set apart, at the level of a junction permitting their electrical continuity.

Figure 17:
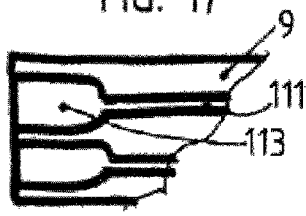
FIG. 17 is a partial schematic elevation view of the end of a lower or upper portion of FIG. 16, at the level of the junction area.

The rabbet 110 is also designed to be capable of receiving a piping 115 a tarpaulin, a curtain, or any other lateral occultation means 116 of the folding structure comprises. Said grooves 111 and 112 are aligned. As shown in FIG. 17, the groove 111 of the lower portion 9 preferably comprises, at least at its upper end, an opening 113 permitting to pass the piping frontally inside the section. The groove 112 of the upper portion 10 comprises, at least at its lower end, an opening 114 analogous to the opening 113. Similar openings can also be made at the other ends of the lower 9 or upper 10 portions of an upright 8. Thus, it is very easy to position and fix such a lateral occultation means 116 to the uprights 8 of the folding structure 1. Such a lateral occultation means 116 can also advantageously be fixed to the covering means 3, in particular at the level of a horizontal connecting panel, through coupling means designed capable of cooperating with complementary coupling means, such as Velcro or the like. The structure thus equipped has then very good waterproofing qualities during bad weather, and its thermal equilibrium can be ensured better.

Said signalization means 109 are designed capable of being supplied with power through autonomous power supply means, for example photovoltaic and/or eolian means, the covering means 3 being then made of materials that are appropriate for this utilization. The power supply of garlands of LEDs can also, considering their very small consumption, advantageously be made by at least one battery; for example a small cell or domestic battery of 12V is sufficient for supplying, for 48 hours, a garland of 400 meters of LEDs.

Such signalization means 109 can also be integrated in the covering means 3, or even in the lateral occultation means 116.

In case it is equipped with such autonomous power supply means, such a structure can thus advantageously be used as a greenhouse or plants forcing framework.

The invention also relates to an upright 8 for constructing such a structure 1.

I claim:

1. A folding shelter assembly movable between an unfolded position to a folded position, the folding shelter assembly comprising:

a plurality of telescopic uprights each having at least one lower element slidably connected to an upper element;

a plurality of mutually-adjacent prismatic box structures supported by said plurality of telescopic uprights, said plurality of mutually-adjacent prismatic box structures having walls formed of crisscrosses of longitudinal members that are scissor articulated, said upper element slidable inside said lower element;

an indexing mechanism suitable for maintaining the lower element and the upper element in the folded position or in the unfolded or in at least one intermediate position between folded position and unfolded position, said indexing mechanism comprising a finger formed of a longitudinal rod, said finger articulated between a locking position and an unlocking position by translation movement on a plate fixed at the bottom of said upper element, the lower element having a tube with a plurality of holes formed therein, one of said plurality of holes corresponding to the intermediate position, another of said plurality of holes corresponding to the folded position, still another of said plurality of holes corresponding to the unfolded position, said finger having an end fitting into one of said plurality of holes, said tube affixed to a bottom end thereof and extending along and inside said lower element, said upper element having a profile that corresponds to and is slidable along and inside a profile of the lower element, said upper element slidable outside of said tube, the lower element and said upper element and said tube being concentric, said upper element having an internal longitudinal space having a cross-sectional shape matching a cross-sectional shape of said tube, said internal longitudinal space having a diameter slightly greater than an outer diameter of said tube.

2. The folding shelter assembly of claim 1, said finger having a compression spring urging said finger to the locking position.

3. The folding shelter assembly of claim 1, said finger having a spherical handle at an opposite end thereof, said spherical handle suitable for manually moving said finger to the unlocking position.

4. The folding shelter assembly of claim 1, further comprising:

a pneumatic jack incorporated into said tube.

5. The folding shelter assembly of claim 1, said upper element having a slide cooperative with a carriage that is slidable along said slide, the longitudinal member being articulated to said carriage.

6. The folding shelter assembly of claim 5, further comprising:

a hook fixed to an upper portion of said upper element, said hook cooperative with an axle affixed to said carriage, said hook being articulated so as to be movable between a locking position and an unlocking position.

7. The folding shelter assembly of claim 6, said hook cooperative with a spring urging said hook to the locking position.

* * * * *